US011261055B2

(12) United States Patent
Blanchard et al.

(10) Patent No.: US 11,261,055 B2
(45) Date of Patent: Mar. 1, 2022

(54) ELEVATOR EMERGENCY STOP SYSTEMS

(71) Applicant: Otis Elevator Company, Farmington, CT (US)

(72) Inventors: Antoine Adrian Blanchard, Chateauneuf sur Loire (FR); Emmanuel Convard, La Bussiere (FR); Arnaud Cazé, Chailly en Gatinais (FR)

(73) Assignee: OTIS ELEVATOR COMPANY, Farmington, CT (US)

( * ) Notice: Subject to any disclaimer, the term of this patent is extended or adjusted under 35 U.S.C. 154(b) by 555 days.

(21) Appl. No.: 16/117,287

(22) Filed: Aug. 30, 2018

(65) Prior Publication Data

US 2019/0084801 A1 Mar. 21, 2019

(30) Foreign Application Priority Data

Sep. 15, 2017 (EP) ..... 17306189

(51) Int. Cl.

*B66B 5/12* (2006.01)
*B66B 1/34* (2006.01)
*B66B 7/06* (2006.01)

(52) U.S. Cl.

CPC ..... *B66B 5/12* (2013.01); *B66B 1/3476* (2013.01); *B66B 7/068* (2013.01)

(58) Field of Classification Search

CPC ..... B66B 5/12; B66B 1/3476; B66B 7/068
See application file for complete search history.

(56) References Cited

U.S. PATENT DOCUMENTS 3,814,216 A * 6/1974 Pisatowski ..... B66B 5/06 187/393
4,548,297 A * 10/1985 Salmon ..... B66B 7/08 187/411
5,490,577 A * 2/1996 Yoo ..... B66B 7/08 187/252
5,564,530 A * 10/1996 Iwakiri ..... B66B 7/08 187/348

(Continued)

FOREIGN PATENT DOCUMENTS

CN 101966947 A 2/2011
EP 1369372 A1 12/2003

(Continued)

OTHER PUBLICATIONS

JP2008189462—Machine Translation (Year: 2008).*

(Continued)

*Primary Examiner* — Michael A Riegelman
(74) *Attorney, Agent, or Firm* — Cantor Colburn LLP

(57) ABSTRACT

Elevator systems and methods of operation include a tension member support positioned within an elevator shaft, a tension member suspended from the tension member support within the elevator shaft, and a slack detection system. The slack detection system includes at least one biasing element housed within the tension member support and operably coupled to the tension member, the at least one biasing element arranged to receive a load from the tension member and a switch arranged to be moved from a first position to a second position in response to movement of the at least one biasing element, wherein when in the second position the switch triggers an emergency stop of an elevator car within the elevator shaft.

20 Claims, 7 Drawing Sheets

(56) References Cited

U.S. PATENT DOCUMENTS

| | | | | |
|---|---|---|---|---|
| 5,820,214 | A * | 10/1998 | Bessette | A47C 7/42 297/228.13 |
| 5,862,888 | A * | 1/1999 | Iwakiri | B66B 7/08 187/345 |
| 6,065,569 | A * | 5/2000 | Fuller | B66B 1/42 187/292 |
| 6,170,614 | B1 * | 1/2001 | Herkel | B66B 1/32 187/287 |
| 6,216,824 | B1 * | 4/2001 | Fuller | B66B 7/08 187/292 |
| 8,939,262 | B2 * | 1/2015 | Schienda | B66B 5/06 187/287 |
| 10,947,088 | B2 * | 3/2021 | Blanchard | B66B 7/062 |
| 2004/0074706 | A1 * | 4/2004 | Ramseier | B66C 15/02 188/65.1 |
| 2004/0149048 | A1 * | 8/2004 | Attinger | B66B 5/12 73/862.393 |
| 2005/0133312 | A1 * | 6/2005 | Kaczmarek | B66B 7/068 187/266 |
| 2008/0067012 | A1 * | 3/2008 | Kobrehel | B60P 1/02 187/377 |
| 2011/0297489 | A1 * | 12/2011 | Blanchard | B66B 7/10 187/411 |
| 2012/0024637 | A1 * | 2/2012 | Henneau | B66B 5/125 187/394 |
| 2012/0105242 | A1 * | 5/2012 | Pereira | G01L 5/102 340/668 |
| 2015/0075917 | A1 * | 3/2015 | Kattainen | B66B 1/32 187/288 |
| 2019/0010025 | A1 * | 1/2019 | Blanchard | B66B 5/284 |
| 2019/0084801 | A1 * | 3/2019 | Blanchard | B66B 5/12 |
| 2020/0198931 | A1 * | 6/2020 | Fauconnet | B66B 5/22 |
| 2021/0002103 | A1 * | 1/2021 | Rocher | B66B 11/008 |

FOREIGN PATENT DOCUMENTS

| | | | |
|---|---|---|---|
| EP | 1481933 | | 12/2004 |
| EP | 1538121 | | 6/2005 |
| EP | 1604935 | A1 | 12/2005 |
| EP | 1767483 | | 3/2007 |
| EP | 2347986 | | 7/2011 |
| EP | 2855323 | | 4/2015 |
| EP | 3191395 | | 7/2017 |
| JP | 6036977 | U | 3/1985 |
| JP | 2008037521 | A | 2/2008 |
| JP | 2008189462 | A | 8/2008 |
| JP | 2008265924 | | 11/2008 |
| JP | 6445658 | B1 | 12/2018 |
| WO | 2007144456 | A1 | 12/2007 |
| WO | 2016040452 | A1 | 3/2016 |
| WO | 2016091531 | | 6/2016 |

OTHER PUBLICATIONS

JPS6036977 (Year: 1985).*

"Controller Installation Manual", Motion Engineering, Inc., revised Feb. 5, 2009; 387 pages.

European Search Report, European Application No. 17306189.6, dated Mar. 6, 2018, European Patent Office; European Search Report 10 pages.

* cited by examiner

ELEVATOR EMERGENCY STOP SYSTEMS

CROSS REFERENCE TO RELATED APPLICATIONS

This application claims the benefit of European Application No. 17306189.6, filed Sep. 15, 2017, which is incorporated herein by reference in its entirety.

BACKGROUND

The subject matter disclosed herein generally relates to elevator systems and, more particularly, elevator emergency stop systems.

Elevator systems typically include an elevator car, a counterweight, and one or more tension members (e.g., rope(s), belt(s), cable(s), etc.) that connect the elevator car and the counterweight. During operation of such elevator system, it is important to monitor several operating conditions of the overall assembly, including tension upon the tension member(s). For example, the overall load of the elevator car must be monitored to ensure that a design load, such as a maximum capacity load, is not exceeded. Additionally, the condition of the tension members must be monitored, as the tension members bear the load of the elevator car and the contents therein (e.g., passengers). Commonly, the weight of the elevator car is obtained by devices separate from devices employed to monitor the condition of the tension members, as separate mechanical slack rope devices are often utilized to detect slack conditions of the tension members. This common arrangement requires a large number of detection devices and processing components to separately monitor the weight of the elevator car and slack conditions of the tension members.

SUMMARY

According to some embodiments, elevator systems are provided. The elevator systems include a tension member support positioned within an elevator shaft, a tension member suspended from the tension member support within the elevator shaft, and a slack detection system. The slack detection system includes at least one biasing element housed within the tension member support and operably coupled to the tension member, the at least one biasing element arranged to receive a load from the tension member and a switch arranged to be moved from a first position to a second position in response to movement of the at least one biasing element, wherein when in the second position the switch triggers an emergency stop of an elevator car within the elevator shaft.

In addition to one or more of the features described herein, or as an alternative, further embodiments of the elevator systems may include that the at least one biasing element comprises a first biasing element and a second biasing element, wherein the second biasing element is arranged to interact with the switch, and wherein both the first biasing element and the second biasing element are operably coupled to the tension member.

In addition to one or more of the features described herein, or as an alternative, further embodiments of the elevator systems may include that the first biasing element has a first tension characteristic and the second biasing element has a second tension characteristic, wherein the second tension characteristic of the second biasing element is more responsive to changes in tension loads on the tension member than the first tension characteristic of the first biasing element.

In addition to one or more of the features described herein, or as an alternative, further embodiments of the elevator systems may include that the second biasing element is positioned within the first biasing element.

In addition to one or more of the features described herein, or as an alternative, further embodiments of the elevator systems may include a separation element positioned between the first biasing element and the second biasing element to prevent contact therebetween.

In addition to one or more of the features described herein, or as an alternative, further embodiments of the elevator systems may include an activation element positioned relative to the at least one biasing element such that when the at least one biasing element moves in response to reduction of the load of the tension member, the activation element is urged into contact with the switch.

In addition to one or more of the features described herein, or as an alternative, further embodiments of the elevator systems may include that the activation element is integrally part of the at least one biasing element.

In addition to one or more of the features described herein, or as an alternative, further embodiments of the elevator systems may include an elevator counterweight suspended from the tension member.

In addition to one or more of the features described herein, or as an alternative, further embodiments of the elevator systems may include an emergency stop device, wherein the switch is operably connected to the emergency stop device, and wherein when the switch is moved into the second position, the emergency stop device is operated.

In addition to one or more of the features described herein, or as an alternative, further embodiments of the elevator systems may include that the emergency stop device is part of an elevator safety chain.

In addition to one or more of the features described herein, or as an alternative, further embodiments of the elevator systems may include an elevator controller and an elevator machine, wherein operation of the switch from the first position to the second position causes the elevator controller to stop the elevator machine.

In addition to one or more of the features described herein, or as an alternative, further embodiments of the elevator systems may include at least one load sensor operably coupled to the tension member, the load sensor arranged to detect a change in load on the tension member.

According to some embodiments, methods of performing an emergency stop operation of an elevator system of any preceding embodiment.

In addition to one or more of the features described herein, or as an alternative, further embodiments of the methods may include detecting a reduction in load upon the tension member, operating the at least one biasing element, and urging the switch from the first position to the second position.

In addition to one or more of the features described herein, or as an alternative, further embodiments of the methods may include performing an emergency stop of the elevator system when the switch is in the second position.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The subject matter is particularly pointed out and distinctly claimed at the conclusion of the specification. The foregoing and other features, and advantages of the present disclosure are apparent from the following detailed description taken in conjunction with the accompanying drawings in which:

DETAILED DESCRIPTION

Figure 1:
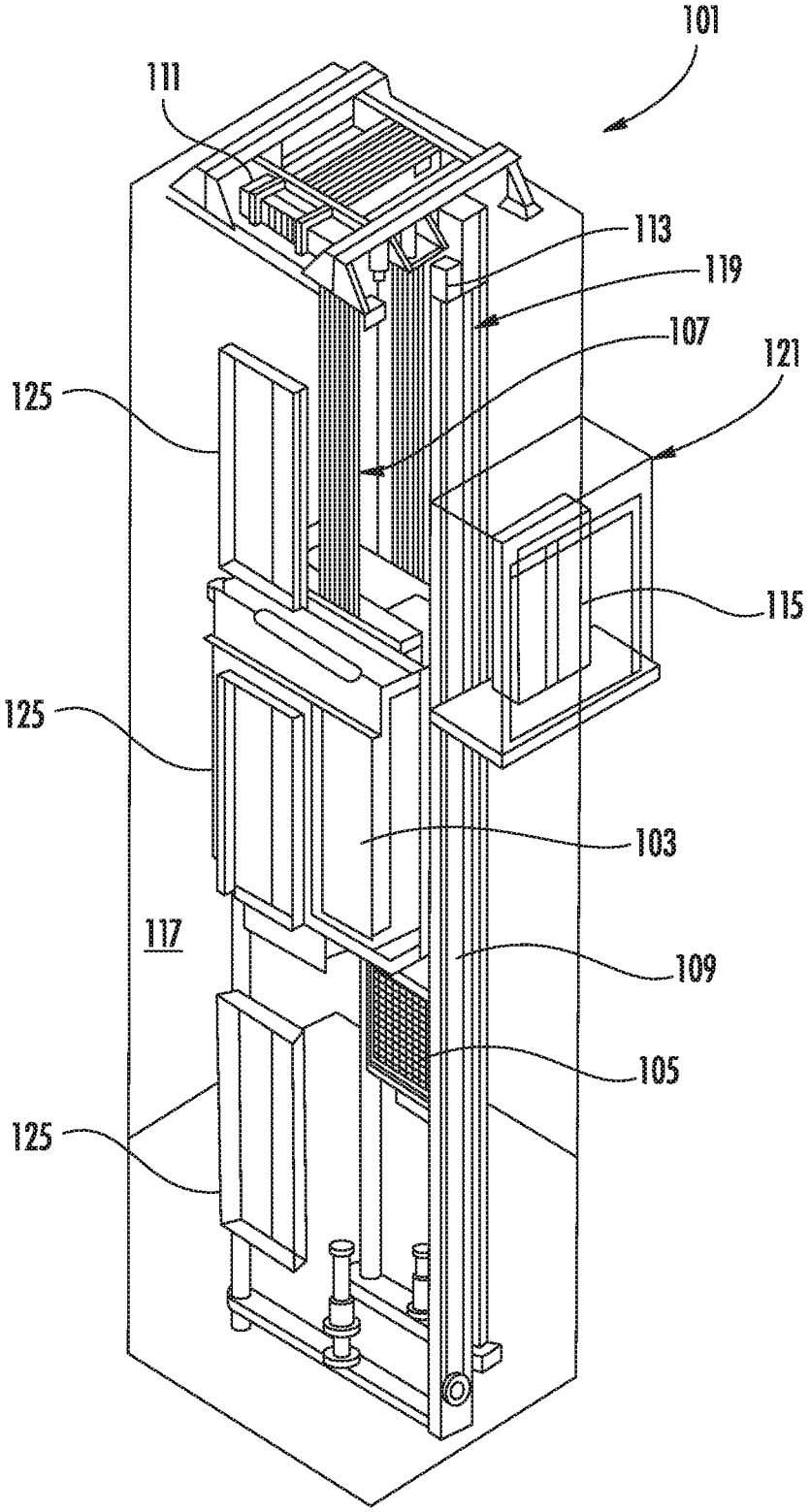
FIG. 1 is a schematic illustration of an elevator system that may employ various embodiments of the present disclosure.

FIG. 1 is a perspective view of an elevator system 101 including an elevator car 103, a counterweight 105, a tension member 107, a guide rail 109, a machine 111, a position encoder 113, and a controller 115. The elevator car 103 and counterweight 105 are connected to each other by the tension member 107. The tension member 107 may include or be configured as, for example, ropes, steel cables, and/or coated-steel belts. The counterweight 105 is configured to balance a load of the elevator car 103 and is configured to facilitate movement of the elevator car 103 concurrently and in an opposite direction with respect to the counterweight 105 within an elevator shaft 117 and along the guide rail 109.

The tension member 107 engages the machine 111, which is part of an overhead structure of the elevator system 101. The machine 111 is configured to control movement between the elevator car 103 and the counterweight 105. The position encoder 113 may be mounted on an upper sheave of a speed-governor system 119 and may be configured to provide position signals related to a position of the elevator car 103 within the elevator shaft 117. In other embodiments, the position encoder 113 may be directly mounted to a moving component of the machine 111, or may be located in other positions and/or configurations as known in the art.

The controller 115 is located, as shown, in a controller room 121 of the elevator shaft 117 and is configured to control the operation of the elevator system 101, and particularly the elevator car 103. For example, the controller 115 may provide drive signals to the machine 111 to control the acceleration, deceleration, leveling, stopping, etc. of the elevator car 103. The controller 115 may also be configured to receive position signals from the position encoder 113. When moving up or down within the elevator shaft 117 along guide rail 109, the elevator car 103 may stop at one or more landings 125 as controlled by the controller 115. Although shown in a controller room 121, those of skill in the art will appreciate that the controller 115 can be located and/or configured in other locations or positions within the elevator system 101.

The machine 111 may include a motor or similar driving mechanism. In accordance with embodiments of the disclosure, the machine 111 is configured to include an electrically driven motor. The power supply for the motor may be any power source, including a power grid, which, in combination with other components, is supplied to the motor.

Although shown and described with a roping system, elevator systems that employ other methods and mechanisms of moving an elevator car within an elevator shaft may employ embodiments of the present disclosure. FIG. 1 is merely a non-limiting example presented for illustrative and explanatory purposes. For example, in some configurations, some or all of the elevator system components may be arranged and installed directly within the elevator shaft, and thus a machine room or controller room may be eliminated.

Figure 2:
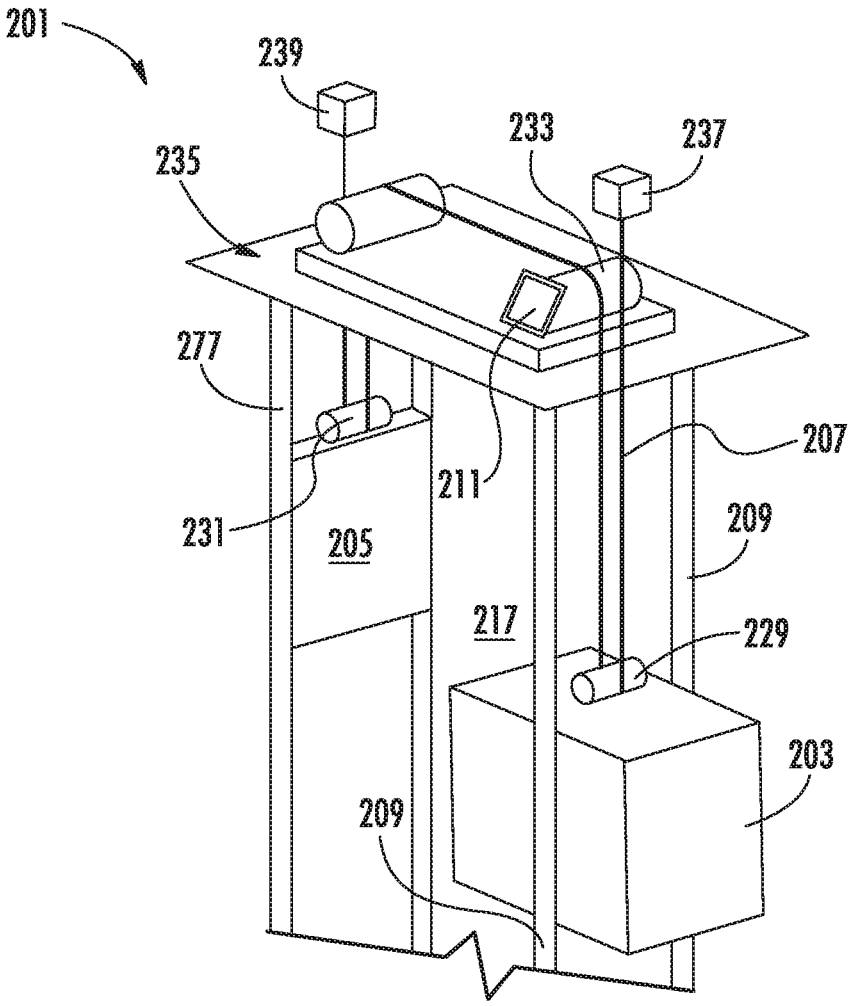
FIG. 2 is a schematic illustration of an elevator system that may employ various embodiments of the present disclosure.

Referring now to FIG. 2, an elevator system 201 is illustrated. The elevator system 201 includes an elevator car 203 configured to move vertically upwardly and downwardly within an elevator shaft 217 along a plurality of car guide rails 209. Guide assemblies mounted to the top and bottom of the elevator car 203 are configured to engage the car guide rails 209 to maintain proper alignment of the elevator car 203 as it moves within the elevator shaft 217.

The elevator system 201 also includes a counterweight 205 configured to move vertically upwardly and downwardly within the elevator shaft 217. The counterweight 205 moves in a direction generally opposite the movement of the elevator car 203 as is known in conventional elevator systems. Movement of the counterweight 205 is guided by counterweight guide rails 227 mounted within the elevator shaft 217. In the illustrated, non-limiting embodiment, the elevator car 203 and counterweight 205 include sheave assemblies 229, 231 that cooperate with at least one tension member 207 and a traction sheave 233 mounted to a drive machine 211 to raise and lower the elevator car 203. The drive machine 211 in the illustrated embodiment of FIG. 2 is suited and sized for use with flat tension members 207. An elevator sheave assembly 229 is mounted to the top of the elevator car 203, and a counterweight sheave assembly 231 is mounted to the counterweight 205. Although shown in FIG. 2 with the sheave assemblies 229, 231 mounted in specific locations/orientations, the sheave assemblies 229, 231 may be mounted at other location on the elevator car 203 and counterweight 205, respectively, such as the bottom thereof or elsewhere in the elevator system 201 as recognized by those of skill in the art.

The drive machine 211 of the elevator system 201 is positioned and supported at a mounting location atop a support 235, such as a bedplate, in a portion of the elevator shaft 217 or a machine room of the elevator system 201. Although the elevator system 201 illustrated and described herein has an overslung 2:1 roping configuration, elevator systems having other roping configurations and elevator shaft layouts are within the scope of the present disclosure. In some embodiments, the counterweight 205 of the elevator system 201 is asymmetric, meaning that the counterweight guide rails 227 and the counterweight 205 movable along the counterweight guide rails 227 are arranged substantially offset from a center of the elevator car 203 and car guide rails 209 within the elevator shaft 217.

Also shown in FIG. 2, the tension member 207 is suspended from two locations, with the tension member 207 extending from a car tension member support 237 to a counterweight tension member support 239. The tension member supports 237, 239 are fixedly attached to and/or mounted to a portion of the elevator shaft 217, such as a ceiling, wall, etc. or are mounted or part of a support structure that enables the tension member 207 to operate within the elevator shaft 217 during operation of the elevator system 201. The tension member supports 237, 239 may be dead-end hitches as will be appreciated by those of skill in the art, with the tension member supports 237, 239 being stationary portions of the tension member 207 or attached thereto.

Figure 3:
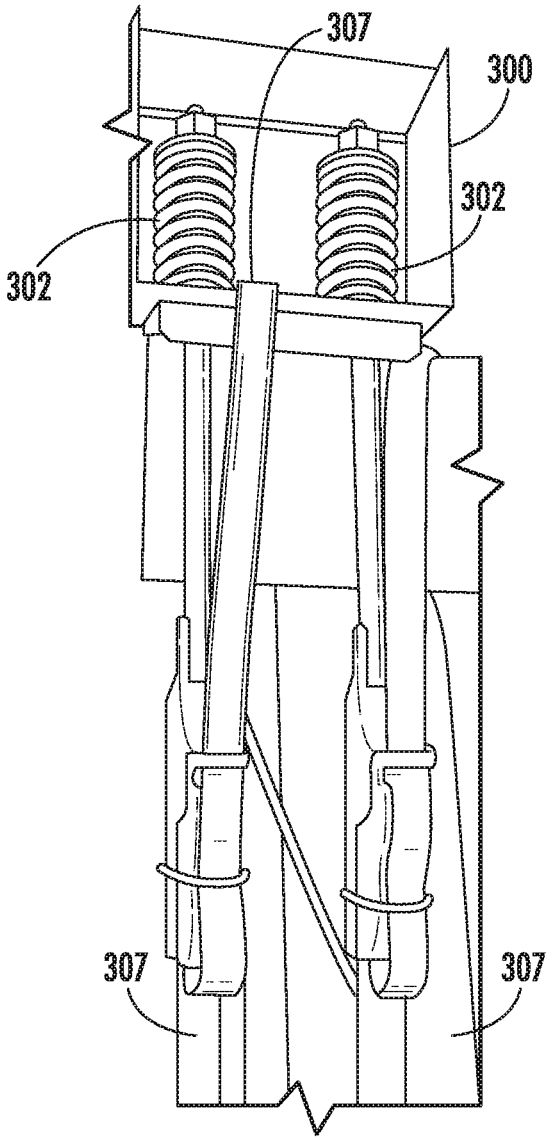
FIG. 3 is a perspective view of a counterweight tension member support system that may incorporate embodiments of the present disclosure.

Turning now to FIG. 3, an enlarged illustration of a tension member support 300 in accordance with an embodiment of the present disclosure is shown. The tension member support 300, as shown, is a box or other frame structure with one or more termination biasing elements 302 installed therein. One or more of the termination biasing elements 302 include an external member and an internal member, as described herein. As shown, a tension member 307 is supported by and suspended from the tension member support 300. As will be appreciated by those of skill in the art, a counterweight can be suspended from or by the tension member 307, as shown and described above. In addition or alternatively, an elevator car can be suspended from or by the tension member 307.

High elevator car overshoots can occur when a counterweight stops on a safety, as will be appreciated by those of skill in the art. The overshoot during a counterweight safety stop is a difference between a maximum car travel from the start of a safety brake application and the safety slide, as will be appreciated by those of skill in the art. Stated another way, an overshoot may be understood as a difference between a maximum height and a final height of the elevator car, provided the counterweight does not move after the safety slide. In such case, the elevator car stores high potential energy when ascending, which turns into high elastic energy in the tension members when the elevator car falls back. As will be appreciated by those of skill in the art, overshoots can induce very high tension in the tension members, and thus fatigue, wear, etc. can be imparted to the tension members. Further, such events may submit passengers to high acceleration when riding in an elevator car, particularly when the elevator car falls back after such event. Additionally, such events can induce tension member entanglement within the elevator shaft.

Accordingly, embodiments provided herein are arranged to automatically identify or react to high reductions of load on counterweight tension members (e.g., ropes or belts) and to trigger an emergency stop of an elevator machine. Such emergency stopping can reduce overshoot of an elevator car in the event of a counterweight safety stop. This is particularly useful when an overshoot switch does not activate (e.g., a false trip). Typically, safety stops are associated with travel of an elevator car. However, when events occur that can cause tension members to go slack, such as overshoots, a monitoring operation, particularly with respect to a counterweight, may be difficult. As such, embodiments provided herein enable a passive monitoring and triggering system for activating an emergency stop of an elevator car, when a slack tension on a tension member associated with a counterweight is detected.

A slack detection system of the present disclosure is located at top of the elevator shaft and integrated within a tension member support for a counterweight. The slack detection systems of the present disclosure can be arranged with a termination biasing element. The termination biasing element may have a stiffness that is pre-set or selected as to be compressed during normal operation and expand or extend if a load acting upon the tension member support or termination biasing element is reduced. At the time of the reduction of load, a triggering contact with an electrical safety system can be initiated, thus activating an emergency stop of an elevator system. In some embodiments, in addition to being passive, an active load monitoring element can be implemented in some embodiments. In such embodiments, a load monitoring device can be operably connected to or attached to a tension member (e.g., on the rope or belt), with the load monitoring device monitoring load and arranged to identify a high load reduction to thus trigger an emergency stop response.

Figure 4A:
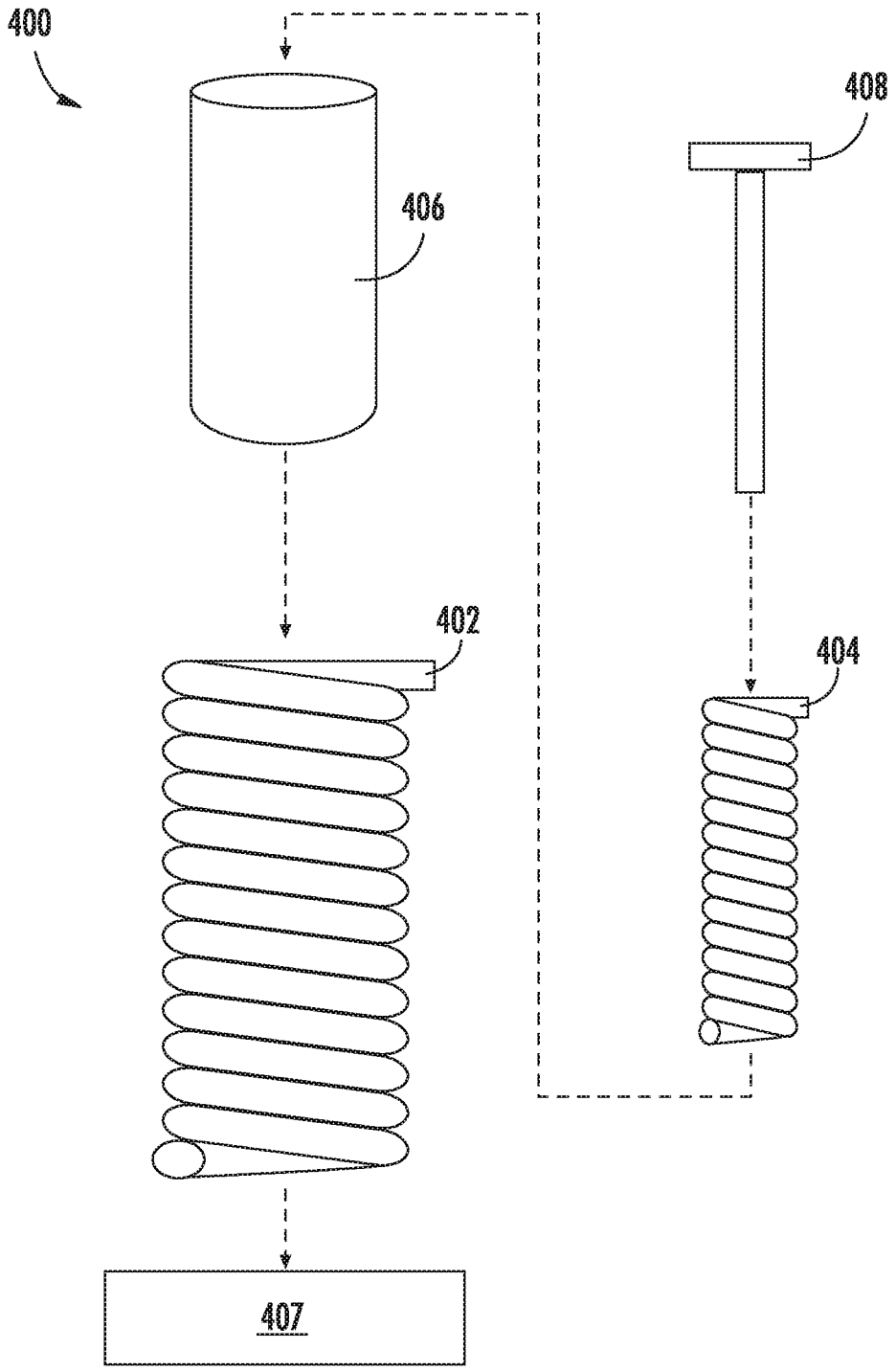
FIG. 4A is an exploded schematic illustration of a slack detection system in accordance with an embodiment of the present disclosure.
Figure 4C:
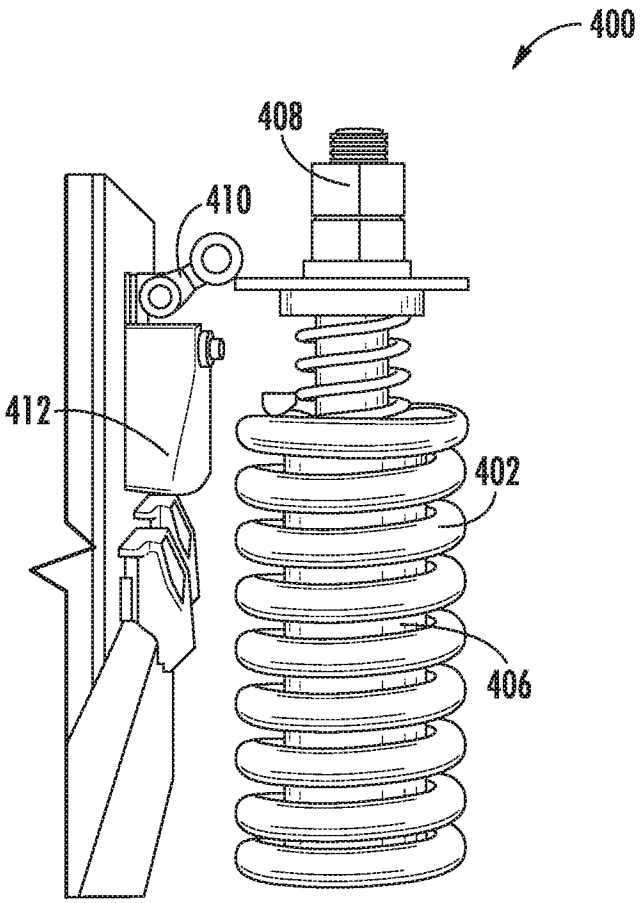
FIG. 4C is a schematic illustration of the slack detection system of FIG. 4A in an activated or emergency state (e.g., when a load is reduced on a monitored tension member)
Figure 4B:
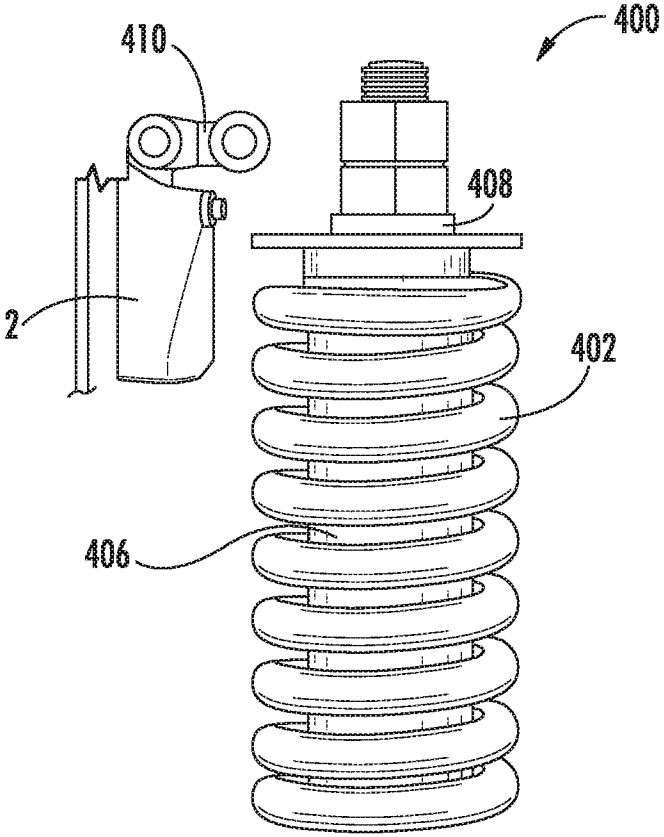
FIG. 4B is a schematic illustration of the slack detection system of FIG. 4A in an inactivated or normal state (e.g., during normal operation of an elevator system)

Turning now to FIGS. 4A-4C, schematic illustrations of a slack detection system 400 in accordance with an embodiment of the present disclosure are shown. The slack detection system 400 can be housed within a tension member support or similar structure and can be operably connected to or in operable communication with a tension member of an elevator system. FIG. 4A is an exploded view illustration of the slack detection system 400; FIG. 4B is a schematic illustration of the slack detection system 400 in an inactivated or normal state (e.g., during normal operation of an elevator system); and FIG. 4C is a schematic illustration of the slack detection system 400 in an activated or emergency state (e.g., when a load is reduced on a monitored tension member).

As shown in FIG. 4A, the slack detection system 400 includes a first biasing element 402, a second biasing element 404, a separation element 406, and an activation element 408. The first biasing element 402 is operably connected to a tension member 407, such as a tension member of an elevator system. In some embodiments, the tension member 407 is operably connected to a counterweight of an elevator system. That is, the first biasing element 402 may be a termination biasing element of an elevator system, as shown and described above and as will be appreciated by those of skill in the art.

In some embodiments, the first biasing element 402 is a spring or similar structure that is arranged to suspend the tension member 407 and an elevator component connected thereto. The first biasing element 402 may have a first tension characteristic, such as a first spring constant. The second biasing element 404 is positioned within the first biasing element 402 and is also operably connected to the tension member 407. The second biasing element 404 has a second tension characteristic, such as a second spring constant. In some embodiments, the second tension characteristic of the second biasing element 404 may be set to be more responsive to changes in tension loads on the tension member 407 than the first tension characteristic of the first biasing element 402. As shown, the separation element 406 is a sleeve or similar housing, structure, or frame that separates the first biasing element 402 from the second biasing element 404. The separation element 406 can be arranged to prevent direction interaction or contact between the first and second biasing elements 402, 404. In normal operation, the first and second biasing elements 402, 404 are compressed and under load. However, when a load is reduced the biasing elements 402, 404, the biasing elements 402, 404 will expand or extend.

The activation element 408 is operably connected to the second biasing element 404, and in some embodiments is housed or positioned within an interior space or cavity of the second biasing element 404. The activation element 408 is arranged to be moveable when acted upon by operation or movement of the second biasing element 404. For example, if a tension load acting upon the second biasing element 404 is reduced, the second biasing element 404 may expand or extend and thus apply a force to act on the activation 408, thus moving the activation element 408. The activation element 408 is arranged to contact a switch of an emergency stop system of an elevator system (e.g., part of a safety chain, as appreciated by those of skill in the art) and as described herein. In some non-limiting embodiments, the second biasing element 404 and the activation element 408 can be integrally formed and/or the second biasing element 404 can be arranged to have a portion thereof contact a switch to achieve the same results as that described herein.

Turning now to FIGS. 4B-4C, schematic illustrations of the slack detection system 400 in operation are shown. FIG. 4B illustrates the slack detection system 400 in normal operational mode (e.g., under tension) and FIG. 4C illustrates the slack detection system 400 in an emergency operational mode (e.g., tension has been reduced). As shown in FIG. 4B, the activation element 408 is housed within the first biasing element 402 and the separation element 406 (and within the second biasing element 404 although such feature is housed within the separation element 406 and thus not visible during normal operation).

As shown, the activation element 408 is positioned relative to a switch 410 that is operably connected to an emergency stop device 412. In some embodiments, the emergency stop device 412 is part of or operably connected to a safety chain of an elevator system. In other embodiments, the emergency stop device 412 is operably connected to an elevator machine, elevator braking system, or other aspect of an elevator system that enables emergency stopping of an elevator car. In some embodiments, the emergency stop device 412 is arranged in wireless communication with an elevator controller or similar component.

As shown, the switch 410 is in a first position, and the activation element 408 is positioned away from the switch 410. The activation element 408 is positioned away from the switch 410 because the second biasing element 404 is compressed and under load. However, as shown in FIG. 4C, when a load is removed or lessened on the second biasing element 404, the second biasing element 404 can extend, thus acting upon the activation element 408 and forcing the activation element 408 toward the switch 410.

As shown in FIG. 4C, a portion of the activation element 408 has moved into contact with the switch 410. The contact of the activation element 408 with the switch 410 urges the switch 410 from a first position (FIG. 4B) to a second position (shown in FIG. 4C). When the switch 410 is moved to the second position, the emergency stop device 412 will trigger an emergency stop of an elevator system.

Figure 5:
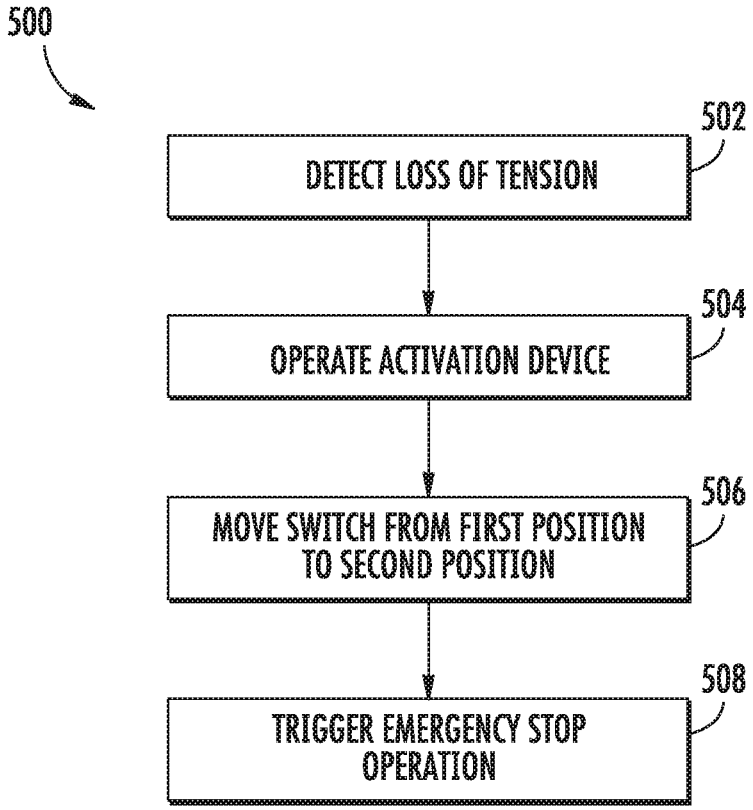
FIG. 5 is a flow process of an emergency stop operation of an elevator system in accordance with the present disclosure.

Turning now to FIG. 5, a flow process 500 of an emergency stop operation of an elevator system in accordance with the present disclosure is shown. The flow process 500 may be performed using systems as shown and described above, or variations thereon. The flow process 500 incorporates operation of a slack detection system as described herein, with a biasing element operably connected to a tension member of an elevator system. The biasing element is arranged such that in normal operation of the elevator system the biasing element is under load. However, when the load is reduced or eliminated, the biasing element is arranged to expand or extend such that an activation element is moved into contact with a switch, as described above.

At block 502, the slack detection system detects a loss or tension or load acting upon the biasing element. When this occurs, the biasing element operates to activate or move an activation device, at block 504. The activation device will act upon and move a switch from a first positon to a second position, at block 506. In the second position, the switch triggers an emergency stop operation of the elevator system, at block 508.

In the present disclosure, a loss or reduction of tension or load upon the biasing element may be caused by a slack tension member event. Such slack tension member events may occur during overshoot or over travel of an elevator car. When the tension member goes slack, free movement may occur of one or both of the elevator car and the counterweight, which is not desirable. Accordingly, if a tension member loses tension or load, it is desirable for an automatic means of stopping an elevator car to occur. Embodiments of the present disclosure provide such automatic, and passive, activation of an emergency stop during a slack tension member event.

Figure 6:
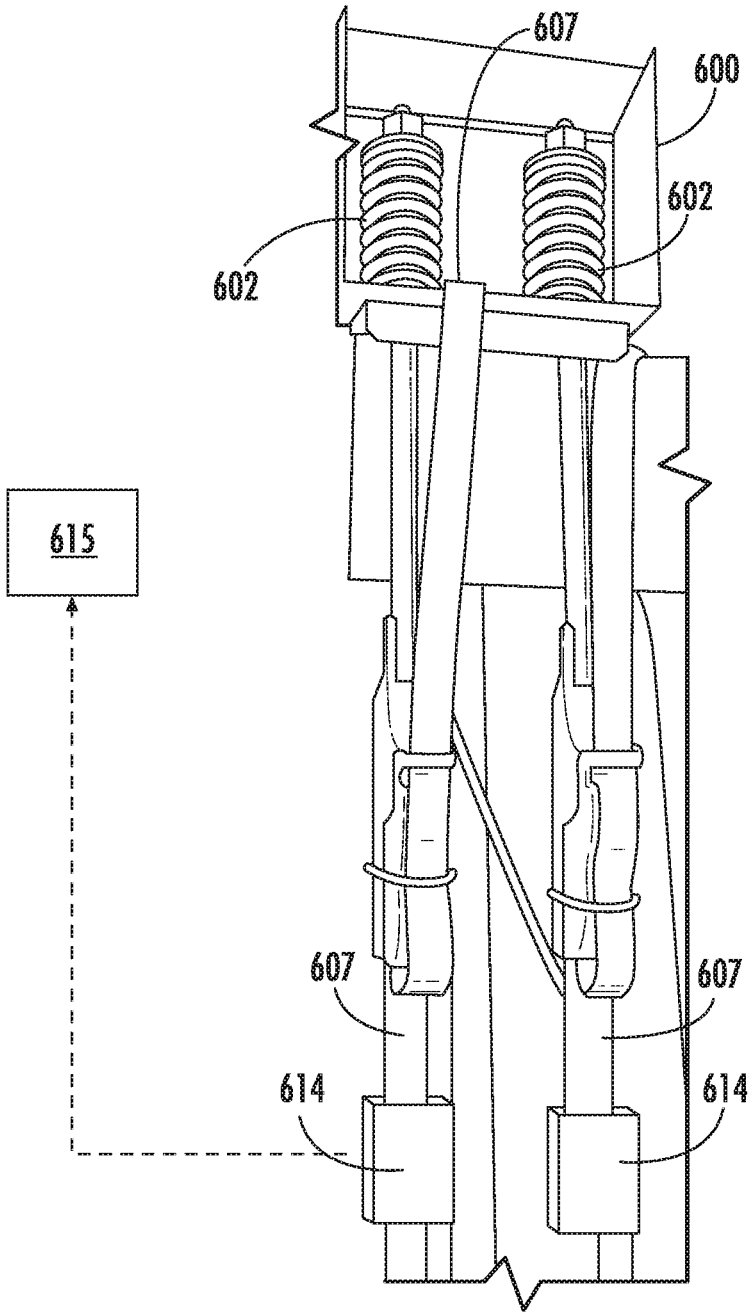
FIG. 6 is a schematic illustration of a slack detection system in accordance with another embodiment of the present disclosure.

In some embodiments, in addition to the passive system described herein, certain arrangements can include active elements as well. For example, referring now to FIG. 6, an enlarged illustration of a tension member support 600 in accordance with an embodiment of the present disclosure is shown. The tension member support 600, as shown, is a box or other frame structure with one or more termination biasing elements 602 installed therein, wherein the termination biasing elements 602 can incorporate features of the slack detection system described above. As shown, a tension member 607 is supported by and suspended from the tension member support 600. As will be appreciated by those of skill in the art, a counterweight can be suspended from or by the tension member 607, as shown and described above. In addition or alternatively, an elevator car can be suspended from or by the tension member 607.

In this embodiment, in addition to the passive slack detection system installed within the tension member support 600, one or more load sensors 614 can be operably coupled to the tension member 607. The load sensors 614 can be electronic or other types of sensors that are arranged to detect a tension or load present on or in the tension members 607. The load sensors 614 are in communication with an elevator controller 615. The load sensors 614 can transmit continuous load data to the controller 615 for constant monitoring or the load sensors 614 may be arranged to trigger a communication when a detected load is reduced below a predetermined threshold. If continuous data is transmitted from the load sensors 614 to the controller 615, the controller 615 can process the data to monitor load on the tension member 607. In the event of low, reduced, or no load detected on the tension member 607, the controller 615 can control the elevator system to perform an emergency stop.

Although shown and described herein with respect to a counterweight associated slack event, those of skill in the art will appreciate that embodiments of the present disclosure can be configured with respect to elevator car movement. That is, although shown and described with respect to tension member support(s) that support a counterweight (e.g., counter weight tension member support 239 shown in FIG. 2), embodiments provided herein can also be used employed in tension member support(s) that support the elevator car (e.g., elevator car tension member support 237 shown in FIG. 2).

Further, although shown and described with a specific triggering mechanism and arrangement of electrical components, various other arrangements are possible without departing from the scope of the present disclosure. For example, in some embodiments, the slack detection systems may be arranged to initiate a bypass of passive electrical components that are configured to operate at typically slower applications of the brake(s). That is, such slack detection systems can override brake application(s) that may not be sufficiently rapid enough in the event of an overshoot to stop the elevator car and/or the counterweight.

Advantageously, embodiments provided herein are directed to systems for quickly stopping an elevator car and/or machine during a counterweight safety stop event. Such stopping can lead to less overshoot and less acceleration for passengers during fallback. Further, advantageously, various embodiments of the present disclosure do not require electric wiring from the top of an elevator shaft to a counterweight that is moveable within the elevator shaft.

Advantageously, because the slack detection device of the present disclosure is associated with a tension member support, rather than the tension member itself, there is no requirement for electrical wiring to the counterweight itself. In contrast, existing electrical systems can be used to provide power to the slack detection devices of the present disclosure.

Those of skill in the art will appreciate that various example embodiments are shown and described herein, each having certain features in the particular embodiments, but the present disclosure is not thus limited. That is, features of the various embodiments can be exchanged, altered, or otherwise combined in different combinations without departing from the scope of the present disclosure.

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions, combinations, sub-combinations, or equivalent arrangements not heretofore described, but which are commensurate with the scope of the present disclosure. Additionally, while various embodiments of the present disclosure have been described, it is to be understood that aspects of the present disclosure may include only some of the described embodiments.

Accordingly, the present disclosure is not to be seen as limited by the foregoing description, but is only limited by the scope of the appended claims.

What is claimed is:

1. An elevator system comprising:

a tension member support positioned within an elevator shaft;

a tension member suspended from the tension member support within the elevator shaft; and a slack detection system comprising:

at least one biasing element housed within the tension member support and operably coupled to the tension member, the at least one biasing element arranged to receive a load from the tension member; and a switch arranged to be moved from a first position to a second position in response to movement of the at least one biasing element, wherein, when in the second position, the switch is configured to trigger an emergency stop of an elevator car within the elevator shaft;

wherein the at least one biasing element comprises a first biasing element and a second biasing element, the second biasing element is arranged to interact with the switch, and both the first biasing element and the second biasing element are operably coupled to the tension member, with the second biasing element being positioned within the first biasing element; and a separation element positioned between the first biasing element and the second biasing element and configured to prevent contact between the first biasing element and the second biasing element.

2. The elevator system of claim 1, wherein the first biasing element has a first tension characteristic and the second biasing element has a second tension characteristic, wherein the second tension characteristic of the second biasing element is more responsive to changes in tension loads on the tension member than the first tension characteristic of the first biasing element.

3. The elevator system of claim 1, further comprising an activation element positioned relative to the second biasing element such that when the second biasing element moves in response to reduction of the load of the tension member, the activation element is urged into contact with the switch.

4. The elevator system of claim 3, wherein the activation element is integrally part of the at least one biasing element.

5. The elevator system of claim 1, further comprising an elevator counterweight suspended from the tension member.

6. The elevator system of claim 1, further comprising an emergency stop device, wherein the switch is operably connected to the emergency stop device, and wherein when the switch is moved into the second position, the emergency stop device is operated.

7. The elevator system of claim 6, wherein the emergency stop device is part of an elevator safety chain.

8. The elevator system of claim 1, further comprising an elevator controller and an elevator machine, wherein operation of the switch from the first position to the second position causes the elevator controller to stop the elevator machine.

9. The elevator system of claim 1, further comprising at least one load sensor operably coupled to the tension member, the load sensor arranged to detect a change in load on the tension member.

10. An elevator system comprising:

a tension member support positioned within an elevator shaft;

a tension member suspended from the tension member support within the elevator shaft; and a slack detection system comprising:

at least one biasing element housed within the tension member support and operably coupled to the tension member, the at least one biasing element arranged to receive a load from the tension member; and a switch arranged to be moved from a first position to a second position in response to movement of the at least one biasing element, wherein, when in the second position, the switch is configured to trigger an emergency stop of an elevator car within the elevator shaft;

wherein the at least one biasing element comprises a first biasing element and a second biasing element, the second biasing element is arranged to interact with the switch, and both the first biasing element and the second biasing element are operably coupled to the tension member, with the second biasing element being positioned within the first biasing element; and a separation element positioned between the first biasing element and the second biasing element and configured to prevent contact between the first biasing element and the second biasing element, wherein the separation element is a sleeve with the second biasing element arranged within the sleeve and the sleeve arranged within the first biasing element.

11. The elevator system of claim 10, wherein the first biasing element has a first tension characteristic and the second biasing element has a second tension characteristic, wherein the second tension characteristic of the second biasing element is more responsive to changes in tension loads on the tension member than the first tension characteristic of the first biasing element.

12. The elevator system of claim 10, further comprising an activation element positioned relative to the second biasing element such that when the second biasing element moves in response to reduction of the load of the tension member, the activation element is urged into contact with the switch.

13. The elevator system of claim 10, further comprising an elevator counterweight suspended from the tension member.

14. The elevator system of claim 10, further comprising an emergency stop device, wherein the switch is operably connected to the emergency stop device, and wherein when the switch is moved into the second position, the emergency stop device is operated.

15. The elevator system of claim 10, further comprising an elevator controller and an elevator machine, wherein operation of the switch from the first position to the second position causes the elevator controller to stop the elevator machine.

16. An elevator system comprising:

a tension member support positioned within an elevator shaft;

a tension member suspended from the tension member support within the elevator shaft; and a slack detection system comprising:

at least one biasing element housed within the tension member support and operably coupled to the tension member, the at least one biasing element arranged to receive a load from the tension member; and a switch arranged to be moved from a first position to a second position in response to movement of the at least one biasing element, wherein, when in the second position, the switch is configured to trigger an emergency stop of an elevator car within the elevator shaft;

wherein the at least one biasing element comprises a first biasing element and a second biasing element, the second biasing element is arranged to interact with the switch, and both the first biasing element and the second biasing element are operably coupled to the tension member, with the second biasing element being positioned within the first biasing element;

a separation element positioned between the first biasing element and the second biasing element and configured to prevent contact between the first biasing element and the second biasing element;

an activation element positioned within an interior space of the second biasing element such that when the second biasing element moves in response to reduction of the load of the tension member, the activation element is urged into contact with the switch.

17. The elevator system of claim 16, wherein the first biasing element has a first tension characteristic and the second biasing element has a second tension characteristic, wherein the second tension characteristic of the second biasing element is more responsive to changes in tension loads on the tension member than the first tension characteristic of the first biasing element.

18. The elevator system of claim 16, further comprising an elevator counterweight suspended from the tension member.

19. The elevator system of claim 16, further comprising an emergency stop device, wherein the switch is operably connected to the emergency stop device, and wherein when the switch is moved into the second position, the emergency stop device is operated.

20. The elevator system of claim 16, further comprising an elevator controller and an elevator machine, wherein operation of the switch from the first position to the second position causes the elevator controller to stop the elevator machine.

* * * * *